US010358826B1

(12) United States Patent
Loccisano

(10) Patent No.: US 10,358,826 B1
(45) Date of Patent: Jul. 23, 2019

(54) WEATHER OVERHANG ASSEMBLY

(71) Applicant: Salvatore Loccisano, Pearl River, NY (US)

(72) Inventor: Salvatore Loccisano, Pearl River, NY (US)

( * ) Notice: Subject to any disclaimer, the term of this patent is extended or adjusted under 35 U.S.C. 154(b) by 0 days.

(21) Appl. No.: 15/949,131

(22) Filed: Apr. 10, 2018

(51) Int. Cl.
*E04D 13/158* (2006.01)

(52) U.S. Cl.
CPC ..... *E04D 13/158* (2013.01)

(58) Field of Classification Search
CPC ..... E04D 13/158
See application file for complete search history.

(56) References Cited

U.S. PATENT DOCUMENTS 2,360,831 A * 10/1944 Drew ..... E04B 1/3205 52/644
3,436,877 A 4/1969 Gunning
5,299,395 A 4/1994 Smith
7,325,362 B1 2/2008 Rowland
8,161,709 B2 4/2012 Saurey
8,737,872 B2 5/2014 Grabow

* cited by examiner

*Primary Examiner* — Andrew J Triggs

(57) ABSTRACT

A weather overhang assembly for installing roof overhangs on a steel building includes a steel building that has a roof, a front wall, a rear wall, a first lateral wall and a second lateral wall. A front overhang is attached to the front wall of the steel building and the front overhang is aligned with the roof. The front overhang extends outwardly beyond the front wall to shield the front wall from precipitation. A back overhang is attached to the back wall of the steel building and the back overhang is aligned with the roof. The back overhang extends outwardly beyond the back wall to shield the back wall from precipitation.

6 Claims, 4 Drawing Sheets

WEATHER OVERHANG ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to overhang devices and more particularly pertains to a new overhang device for installing roof overhangs on a steel building.

BRIEF SUMMARY OF THE INVENTION

An embodiment of the disclosure meets the needs presented above by generally comprising a steel building that has a roof, a front wall, a rear wall, a first lateral wall and a second lateral wall. A front overhang is attached to the front wall of the steel building and the front overhang is aligned with the roof. The front overhang extends outwardly beyond the front wall to shield the front wall from precipitation. A back overhang is attached to the back wall of the steel building and the back overhang is aligned with the roof. The back overhang extends outwardly beyond the back wall to shield the back wall from precipitation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
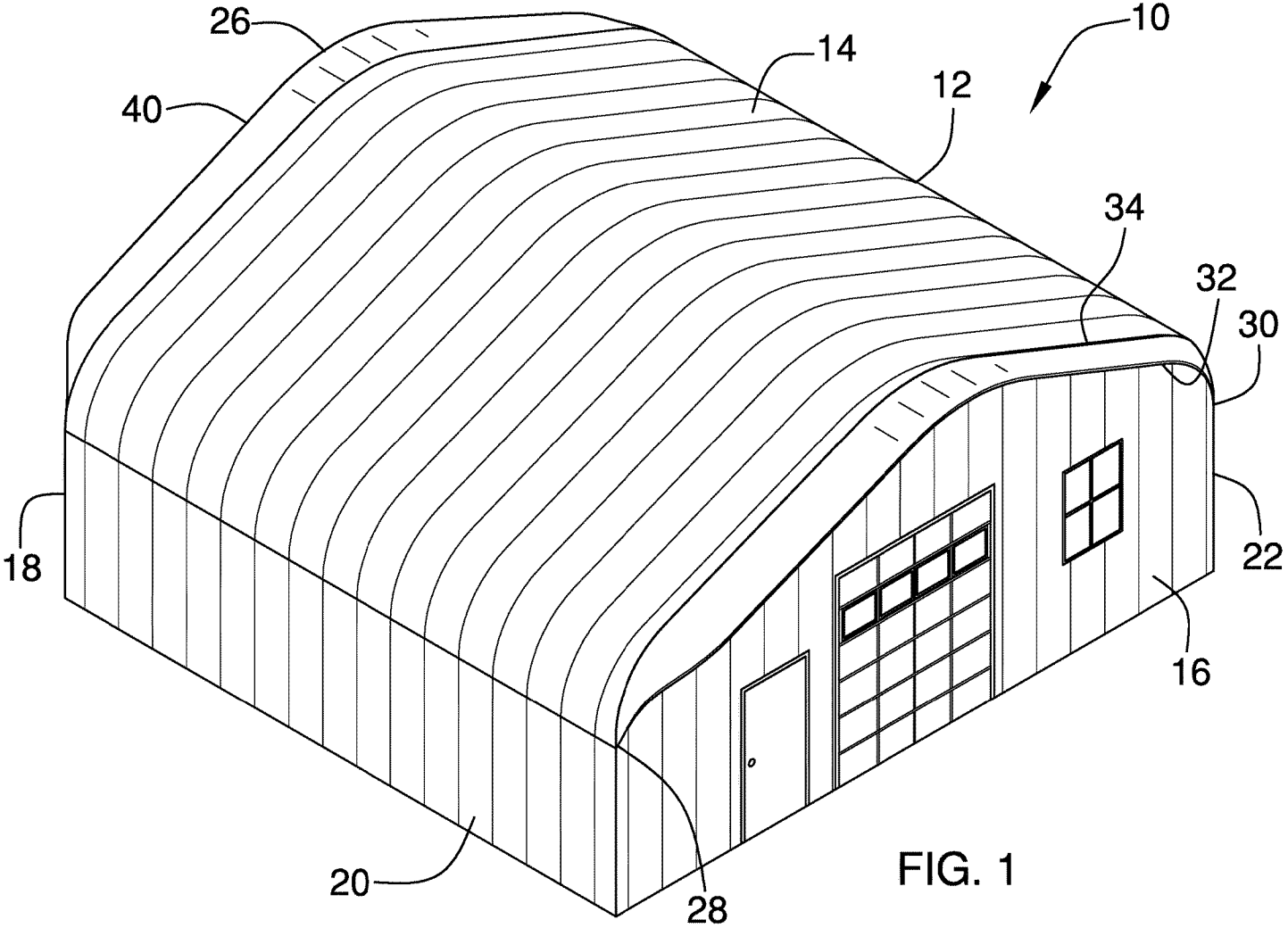
FIG. 1 is a front perspective view of a weather overhang assembly according to an embodiment of the disclosure.
Figure 2:
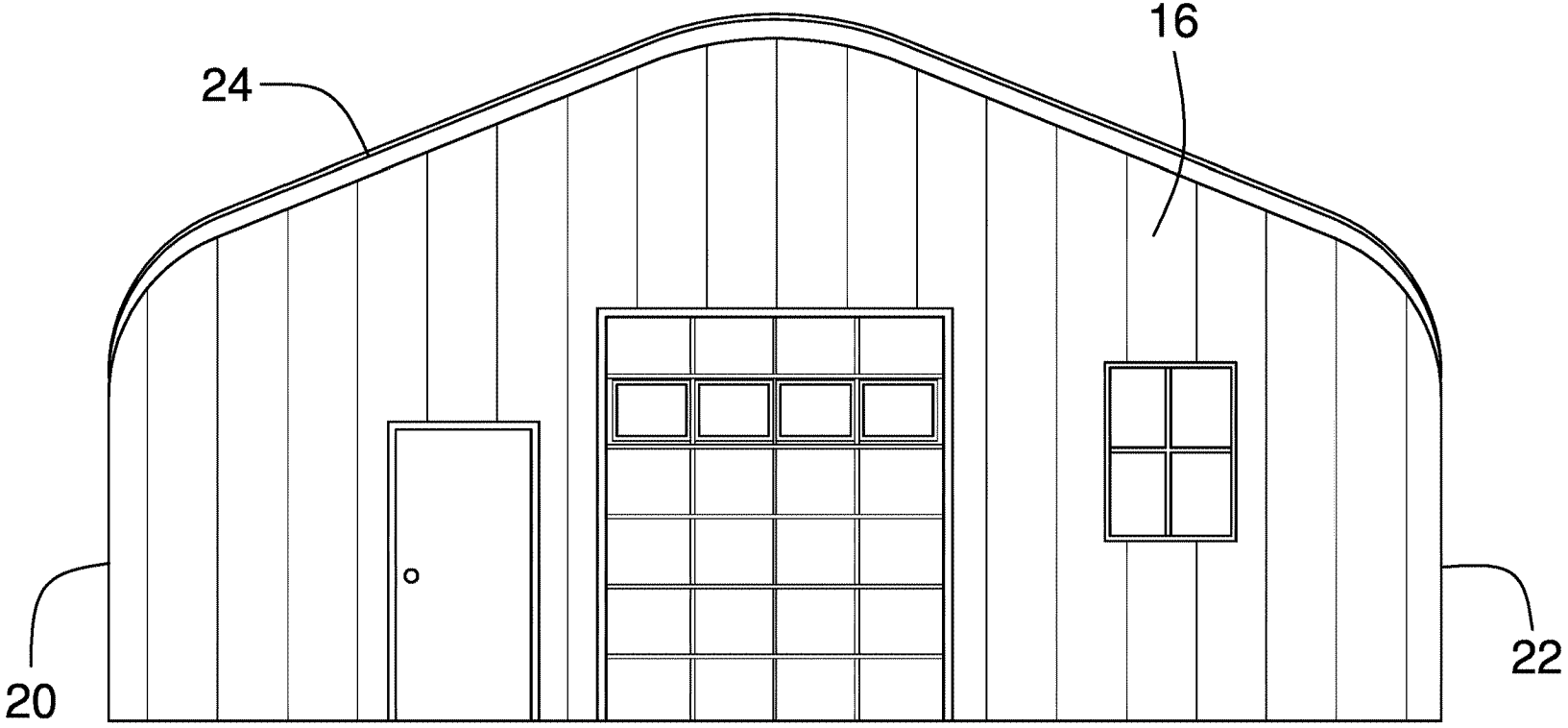
FIG. 2 is a front view of an embodiment of the disclosure.
Figure 3:
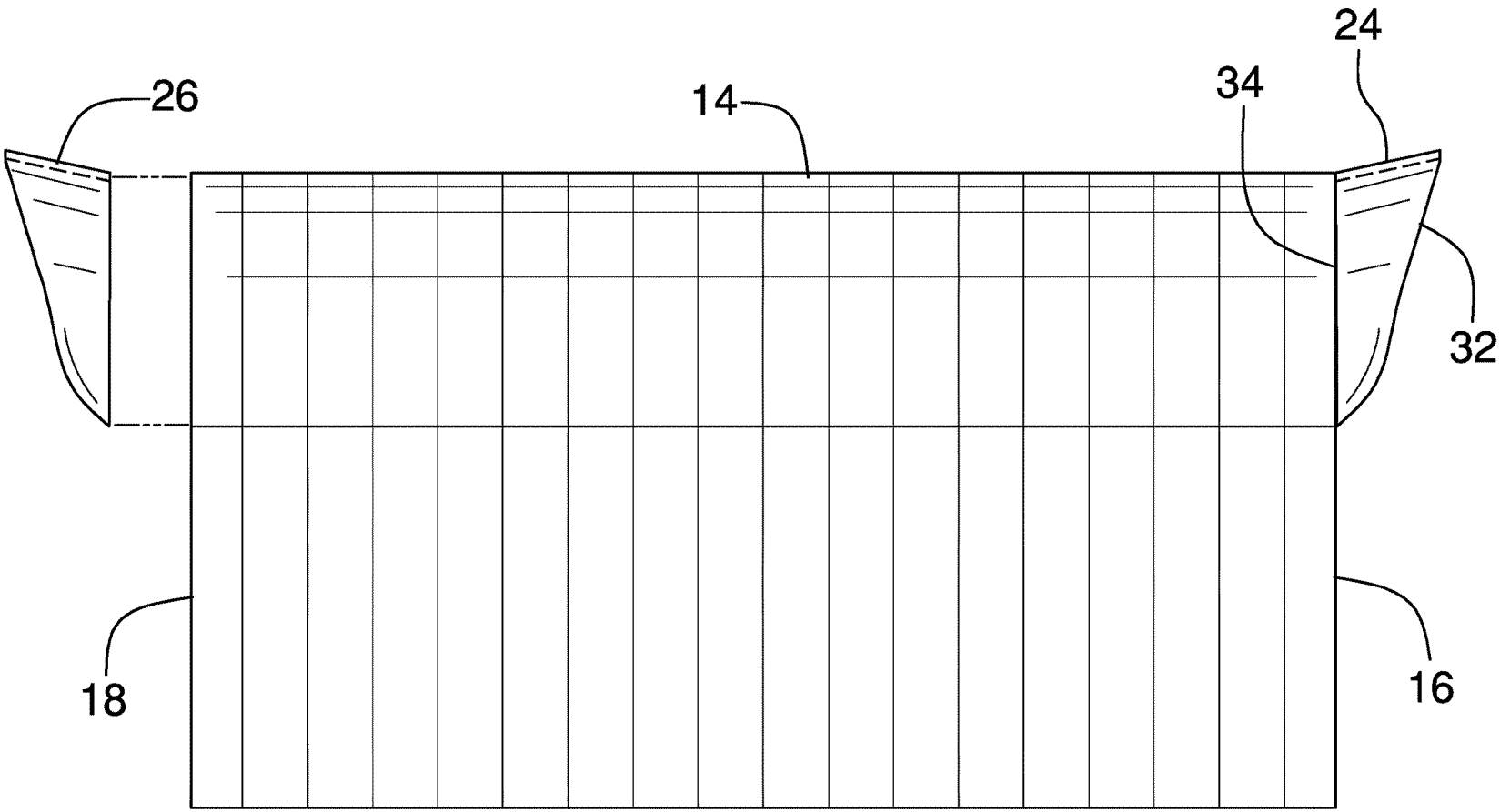
FIG. 3 is a right side view of an embodiment of the disclosure.
Figure 4:
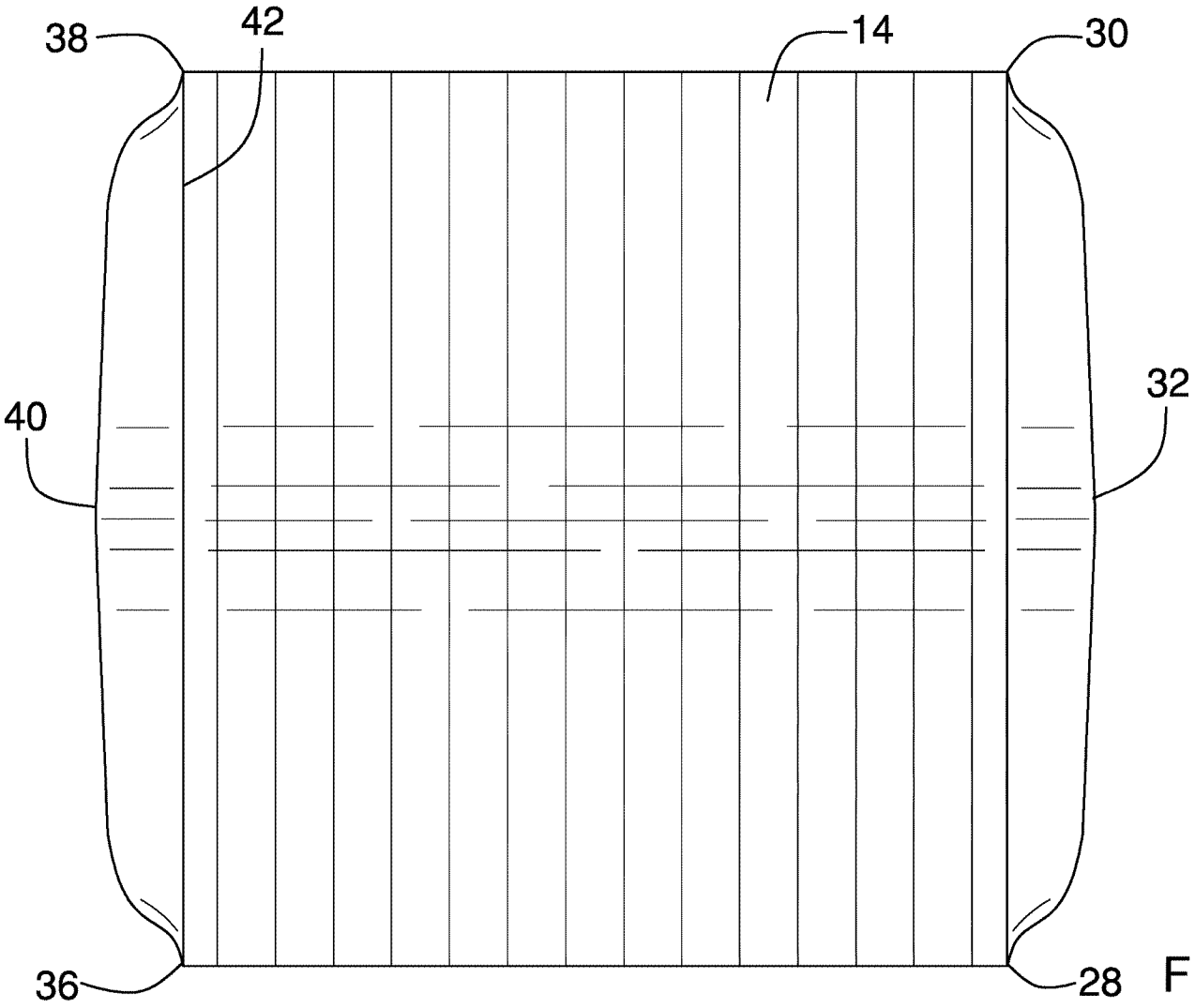
FIG. 4 is a top view of an embodiment of the disclosure.

With reference now to the drawings, and in particular to FIGS. 1 through 4 thereof, a new overhang device embodying the principles and concepts of an embodiment of the disclosure and generally designated by the reference numeral 10 will be described.

As best illustrated in FIGS. 1 through 4, the weather overhang assembly 10 generally comprises a steel building 12 that has a roof 14, a front wall 16, a rear wall 18, a first lateral wall 20 and a second lateral wall 22. The steel building 12 may be a steel building 12 of any conventional design that is constructed without overhangs or overhangs. A front overhang 24 is provided and the front overhang 24 is attached to the front wall 16 of the steel building 12 and the front overhang 24 is aligned with the roof 14. Moreover, the front overhang 24 extends outwardly beyond the front wall 16 to shield the front wall 16 from precipitation. A back overhang 26 is attached to the rear wall 18 of the steel building 12 and the back overhang 26 is aligned with the roof 14. The back overhang 26 extends outwardly beyond the rear wall 18 to shield the rear wall 18 from precipitation.

The front overhang 24 has a first end 28, a second end 30, a front edge 32 extending between the first end 28 and the second end 30, and a back edge 34 extending between the first end 28 and the second end 30. The back edge 34 is attached to the front wall 16 of the steel building 12 having the front edge 32 is spaced from the front wall 16. Additionally, the front edge 32 curves rearwardly toward the back edge 34 adjacent to each of the first end 28 and the second end 30. The first end 28 is aligned with an intersection of the front wall 16 and the first lateral wall 20 and the second end 30 is aligned with an intersection of the front wall 16 and the second lateral wall 22. Moreover, the front overhang 24 has a length that is equal to a length of an intersection between the front wall 16 and the roof 14.

The back overhang 26 has a primary end 36, a secondary end 38, a forward edge 40 extending between the primary end 36 and the secondary end 38, and a rear edge 42 extending between the primary end 36 and the secondary end 38. The rear edge 42 is attached to the rear wall 18 of the steel building 12 having the forward edge 40 being spaced from the rear wall 18. The forward edge 40 curves rearwardly toward the rear edge 42 adjacent to each of the primary end 36 and the secondary end 38. Additionally, the primary end 36 is aligned with an intersection between the first lateral wall 20 and the rear wall 18, and the secondary end 38 is aligned with an intersection between the second lateral wall 22 and the rear wall 18. The back overhang 26 has a length that is equal to a length of an intersection between the rear wall 18 and the roof 14.

In use, the front overhang 24 is attached to the front wall 16 when construction of the steel building 12 has finished. Thus, the front overhang 24 shields the front wall 16 of the steel building 12 from rain, snow and sun. The back overhang 26 is attached to the rear wall 18 when construction of the steel building 12 has finished. Thus, the back overhang 26 shields the rear wall 18 of the steel building 12 from rain, snow and sun. Additionally, each of the front overhang 24 and the back overhang 26 can be retrofitted onto existing steel building 12*s* that do not have overhangs or overhangs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A weather overhang assembly being mounted on a steel building wherein said assembly is configured to shield an entry into said steel building from weather, said assembly comprising:

a steel building having a roof, a front wall, a rear wall, a first lateral wall and a second lateral wall; and a front overhang being attached to said front wall of said steel building, said front overhang being aligned with said roof, said front overhang extending outwardly beyond said front wall wherein said front overhang is configured to shield said front wall from precipitation, said front overhang having a first end, a second end, a front edge extending between said first end and said second end, and a back edge extending between said first end and said second end, said front overhang extending upwardly and away from said steel building wherein said front edge is positioned higher than said rear edge; and a back overhang being attached to said rear wall of said steel building, said back overhang being aligned with said roof, said back overhang extending outwardly beyond said rear wall wherein said back overhang is configured to shield said rear wall from precipitation.

2. The assembly according to claim 1, wherein said front edge curves rearwardly toward said back edge adjacent to each of said first end and said second end.

3. The assembly according to claim 2, wherein said back edge is attached to said front wall of said steel building having said front edge being spaced from said front wall, said first end being aligned with an intersection of said front wall and said first lateral wall, said second end being aligned with an intersection of said front wall and said second lateral wall.

4. The assembly according to claim 1, wherein said back overhang has a primary end, a secondary end, a forward edge extending between said primary end and said secondary end, and a rear edge extending between said primary end and said secondary end, said forward edge curving rearwardly toward said rear edge adjacent to each of said primary end and said secondary end.

5. The assembly according to claim 4, wherein said rear edge is attached to said rear wall of said steel building having said forward edge being spaced from said rear wall, said primary end being aligned with an intersection between said first lateral wall and said rear wall, said secondary end being aligned with an intersection between said second lateral wall and said rear wall.

6. A weather overhang assembly being mounted on a steel building wherein said assembly is configured to shield an entry into said steel building from weather, said assembly comprising:

a steel building having a roof, a front wall, a rear wall, a first lateral wall and a second lateral wall; and a front overhang being attached to said front wall of said steel building, said front overhang being aligned with said roof, said front overhang extending outwardly beyond said front wall wherein said front overhang is configured to shield said front wall from precipitation, said front overhang having a first end, a second end, a front edge extending between said first end and said second end, and a back edge extending between said first end and said second end, said back edge being attached to said front wall of said steel building having said front edge being spaced from said front wall, said front overhang extending upwardly and away from said steel building wherein said front edge is positioned higher than said rear edge, said front edge curving rearwardly toward said back edge adjacent to each of said first end and said second end, said first end being aligned with an intersection of said front wall and said first lateral wall, said second end being aligned with an intersection of said front wall and said second lateral wall; and a back overhang being attached to said rear wall of said steel building, said back overhang being aligned with said roof, said back overhang extending outwardly beyond said rear wall wherein said back overhang is configured to shield said rear wall from precipitation, said back overhang having a primary end, a secondary end, a forward edge extending between said primary end and said secondary end, and a rear edge extending between said primary end and said secondary end, said rear edge being attached to said rear wall of said steel building having said forward edge being spaced from said rear wall, said forward edge curving rearwardly toward said rear edge adjacent to each of said primary end and said secondary end, said primary end being aligned with an intersection between said first lateral wall and said rear wall, said secondary end being aligned with an intersection between said second lateral wall and said rear wall.

* * * * *